US010455939B2

(12) United States Patent
Woodring

(10) Patent No.: US 10,455,939 B2
(45) Date of Patent: Oct. 29, 2019

(54) ONE PIECE INJECTION-MOLDED STACKABLE ROCKING CHAIR

(71) Applicant: Cooper C. Woodring, Wakefield, RI (US)

(72) Inventor: Cooper C. Woodring, Wakefield, RI (US)

( * ) Notice: Subject to any disclaimer, the term of this patent is extended or adjusted under 35 U.S.C. 154(b) by 0 days.

(21) Appl. No.: 16/160,188

(22) Filed: Oct. 15, 2018

(65) Prior Publication Data

US 2019/0116980 A1 Apr. 25, 2019

Related U.S. Application Data

(60) Provisional application No. 62/617,348, filed on Jan. 15, 2018, provisional application No. 62/574,373, filed on Oct. 19, 2017.

(51) Int. Cl.

| | |
|---|---|
| ***A47C 3/029*** | (2006.01) |
| ***A47C 5/12*** | (2006.01) |
| ***A47C 3/04*** | (2006.01) |

(52) U.S. Cl.

CPC ..... *A47C 3/029* (2013.01); *A47C 3/04* (2013.01); *A47C 5/12* (2013.01)

(58) Field of Classification Search

CPC ..... A47C 3/029; A47C 3/04; A47C 5/12
See application file for complete search history.

(56) References Cited

U.S. PATENT DOCUMENTS

| | | | | |
|---|---|---|---|---|
| 763,667 A | | 6/1904 | Hokans | |
| 843,060 A | | 2/1907 | Aronhalt | |
| 5,044,691 A | * | 9/1991 | Guichon | A47C 3/04 297/239 |
| 5,149,035 A | * | 9/1992 | Bonnema | A47C 5/12 248/188.7 |
| D350,650 S | | 9/1994 | Chaney et al. | |
| D360,315 S | | 7/1995 | Morin | |

(Continued)

FOREIGN PATENT DOCUMENTS

| | | | | |
|---|---|---|---|---|
| CA | 2375101 A1 | * | 12/2000 | A47C 1/03277 |
| CA | 2902150 A1 | * | 10/2016 | A47C 3/029 |

*Primary Examiner* — Timothy J Brindley
(74) *Attorney, Agent, or Firm* — Perry Saidman, LLC

(57) ABSTRACT

The present disclosure is directed to a one-piece, injection-molded stackable rocking chair. More specifically, it is directed to the configuration of the rockers that join the rocking chair's front and rear legs. The rockers' interiors contain a plurality of closely-spaced thin-wall ribs configured so that the rocker's interior structure provides the rigidity and structural integrity necessary to pass the government and industry strength tests. The thin-wall ribs may be, for example, configured in a zigzag manner, forming acute angles with respect to the rockers' sidewalls to form triangular-shaped and/or parallelogram-shaped cells. The rockers' top surface may be open so that the thin-wall ribs and cells are visible from above and the rockers' bottom surfaces are closed to spread the weight of an occupied rocking chair over an area large enough to not damage the floor upon which the rocking chair sits. Alternatively, to provide a different aesthetic, the top may be closed and the bottom open. Two such rockers are integrally injection-molded with a rocking chair body to form a one-piece, injection-molded, stackable rocking chair, preferably in resin and preferably in a two-part mold.

22 Claims, 10 Drawing Sheets

(56) References Cited

U.S. PATENT DOCUMENTS

| | | | | | |
|---|---|---|---|---|---|
| D360,550 | S | * | 7/1995 | Ford | D6/708.23 |
| 5,605,526 | A | * | 2/1997 | Hatfield | A47C 3/029 482/129 |
| D380,633 | S | | 7/1997 | Shaw | |
| 5,702,152 | A | | 12/1997 | Shaw | |
| 5,833,307 | A | | 11/1998 | Leach et al. | |
| 5,839,781 | A | | 11/1998 | Knape | |
| D412,406 | S | | 8/1999 | Stumpf et al. | |
| D414,629 | S | * | 10/1999 | Perl | D6/708.23 |
| D430,982 | S | * | 9/2000 | Kuo | D6/708.23 |
| D437,513 | S | * | 2/2001 | Privatt | D6/366 |
| 6,416,123 | B1 | | 7/2002 | Bell | |
| 7,296,859 | B1 | * | 11/2007 | Branch, III | A47C 3/029 297/440.14 |
| 8,070,229 | B2 | | 12/2011 | Woodring | |
| 8,313,141 | B2 | | 11/2012 | Woodring | |
| D703,961 | S | * | 5/2014 | Woodring | D6/348 |
| 8,770,664 | B1 | * | 7/2014 | Leal | A47C 1/032 297/325 |
| 8,960,792 | B1 | | 2/2015 | Woodring | |
| 9,504,329 | B2 | | 11/2016 | Adams, IV et al. | |
| 9,510,681 | B2 | | 12/2016 | Woodring | |
| 9,955,788 | B1 | * | 5/2018 | Montague | A47C 7/22 |
| 2010/0066139 | A1 | * | 3/2010 | Woodring | A47C 3/029 297/239 |
| 2014/0125100 | A1 | * | 5/2014 | Jackson | A47C 3/029 297/258.1 |
| 2015/0044419 | A1 | * | 2/2015 | Carson, Jr. | A47C 5/12 428/138 |
| 2018/0271288 | A1 | * | 9/2018 | Fletcher | A47C 3/029 |
| 2018/0325262 | A1 | * | 11/2018 | Richardson | A47C 3/029 |

* cited by examiner

ONE PIECE INJECTION-MOLDED STACKABLE ROCKING CHAIR

CROSS-REFERENCE TO RELATED APPLICATIONS

This application claims priority to my prior provisional patent application Nos. 62/574,373 filed Oct. 19, 2017, and 62/617,348 filed Jan. 15, 2018, both of which are specifically incorporated herein by reference.

BACKGROUND OF THE DISCLOSURE

Wikipedia defines a rocker within the context of a rocking chair, as follows: "A rocking chair is a type of chair having two curved bands, known as rockers, attached to the bottom of the legs, connecting the legs on each side to each other. The rockers contact the floor at only two points, giving the occupant the ability to rock back and forth by shifting their weight or pushing lightly with their feet."

The present disclosure is directed to novel rockers for an injection-molded rocking chair that allows the chair with the integral rockers to be manufactured in one-piece while satisfying all relevant government and industry tests.

DESCRIPTION OF RELATED ART

Two known injection-molded, stacking rocking chairs comprise the Adams Manufacturing Corporation's Big Easy® and Lil' Easy® rocking chairs. The two chairs are essentially the same, except the Big Easy® is an adult-sized chair and the UT Easy® is a child-sized chair.

Both chairs are manufactured by Adams under license of Cooper C. Woodring's U.S. Pat. No. 8,070,229 issued Dec. 6, 2011, U.S. Pat. No. 8,313,141 issued Nov. 20, 2012, U.S. Pat. No. 8,960,792 issued Feb. 24, 2015 and U.S. Pat. No. 9,510,681 issued Dec. 6, 2016, all of which are specifically incorporated herein by reference.

Both of Adams' rocking chairs have downwardly and outwardly diverging cavities below the seat that allow them to stack or nest one largely within another. Adams' rocking chairs have armrests that are integrally molded with and join together the seat and the backrest.

The rockers disclosed in the above four patents fall into two categories. One is a planar rocker with a curved bottom edge making contact with the ground. That rockers' configuration was found not to have adequate structural integrity and strength necessary to pass the required government tests. The second category had a thickening of the wall thickness at the rockers' lower edges. That version was not tested because the increased thickness would have lengthened mold cycle time to an undesirable degree that would have added to the rocking chair's cost resulting from the slower cycle time and the fewer number of rocking chairs that could be molded in any given time period.

Additionally, Adams has its own U.S. Pat. No. 9,504,329 issued Nov. 29, 2016. The '329 patent discloses an inverted "U" shaped rocker (open at the bottom, closed at the top) that has several internal reinforcing ribs (indicated by his reference numeral 16) oriented perpendicularly to the rocker's sidewalls. The rocker sidewalls and perpendicular ribs form rectangular, box-dike structures within the rockers that are said to strengthen the rocker sidewalls.

The '329 patent also discloses a pair of snap-fit rocker strips 10 and 11 each described as a "removable base" that close the open bottoms of the inverted "U" shaped rockers, and it is the rocker strips 10 and 11 that ostensibly make contact with the ground. Thus, the '329 patent discloses a plastic rocking chair consisting of three components: (1) a one-piece rocking chair body including integral rockers; and (2 & 3) a rocker strip attached to the bottom of each rocker. Each of these three components must be individually molded, and thereafter assembled. Adams makes the rocking chair body in one mold, and the two rocker strips are made in a second mold. Thus, the structure described in Adams' '329 patent does not result in a one-piece rocking chair since two rocker strips are required in order to provide sufficient strength and rigidity to the rockers to pass the required tests.

Adams' '329 patent specifically covers the three-piece Big Easy® and Lil' Easy® rocking chairs that are currently on the market. The three-part construction and labor-required molding and assembly process, are more expensive than would be a rocking chair that requires only one mold and no assembly or labor by an operator.

The present disclosure overcomes the additional cost of a three-piece rocking chair by providing a one-piece rocking chair that requires only one mold, no assembly, no labor, and that has the necessary structural integrity and strength to pass the required government tests. A one-piece rocking chair is therefore of significant value to any manufacturer of multiple-piece, stackable, injection-molded, rocking chairs due primarily to its lower cost of manufacture, and therefore lower price point at retail, resulting in greater sales. The one-piece construction also reduces the probability of squeaking and creaking that can occur with Adams' rockers having snap-fit rocker strips due to the small movement between the rockers and the rocker strips when the rocking chair is heavily loaded by a user. Additionally, Adams' rocker strips fit in-between the rocker's two sidewalls, not covering the rocker's two sidewalls, such that when the rocking chair is heavily loaded, the rocker strips are compressed to the extent that the rocker's relatively thin inner and outer sidewalls may well come into contact with the surface or floor upon which the rocking chair sits, damaging the surface or the floor.

SUMMARY OF THE DISCLOSURE

The rocking chair of the present disclosure includes a pair of "U" shaped, downwardly curved rockers, each having a plurality of internal, closely spaced thin-wall ribs extending in a zigzag manner between the inner and outer sidewalls of the rocker. The thin-wall ribs form an acute angle with the sidewalls of the rocker, resulting in a plurality of closely-spaced polygonal cells that provide rigidity, structural integrity and strength. The cells may be formed into various configurations, including triangular-shaped interior cells, parallelogram-shaped interior cells and triangular-shaped interior cells combined with parallelogram-shaped interior cells. The rockers are open on their top surface such that the portion of the metal mold forming the interior cells of the rocker can be removed in an upward motion. The thin-wall ribs therefore are oriented at the same angle with respect to one another.

The multiple, closely-spaced, thin-wall ribs allow their wall thicknesses to remain thin, not exceeding the wall thicknesses of the rocking chair body, thereby not requiring additional mold cycle time that would be required by thicker walls. The thickness of the thin-wall ribs of the present disclosure may be, for example, 1/32 of an inch (0.03125"), or even less.

The height of the rockers' thin-wall ribs may be of equal height or may vary in height. The rockers' thin-wall ribs may be of equal wall thickness or may vary in wall thickness. The spacing between the thin-wall ribs' point-of-attachment to the inner and outer sidewalls may be equal or may vary, as will be described in greater detail below.

The rocker described above has an integrally injection-molded closed bottom surface and an open top surface. The closed bottom surface provides maximum rocker to ground contact surface and the open top allows the rocker's internal structure to be injection-molded and to be visible. The closed bottom surface will preferably have drain openings in the internal structure's cells to drain any liquid.

In an alternate configuration, the rocker may have an open bottom and closed top, which may be more aesthetically pleasing.

DETAILED DESCRIPTION

Figure 1:
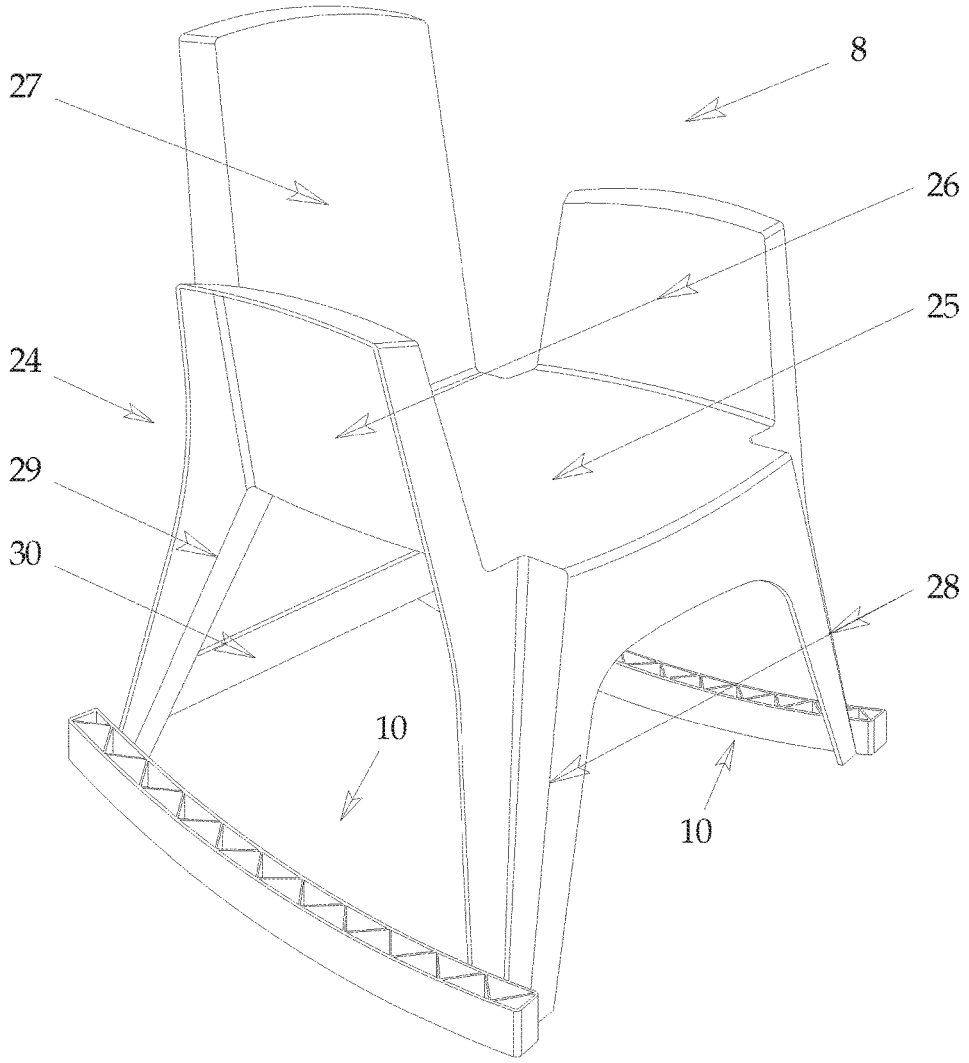
FIG. 1 is a perspective view of one example of a rocking chair of the present disclosure.

FIG. 1 shows one example of an injection-molded, stackable rocking chair 8 of the present disclosure having a pair of rockers 10 integrally molded with a rocking chair body 24.

The stackable rocking chair 8 comprises a seat 25 integrally molded with and joined with a pair of arms 26, a back 27, a pair of front legs 28 and a pair of rear legs 29 (only one of the rear legs 29 appears in this view). In this example, the arms 26 are integrally molded with and joined with the seat 25, the front legs 28 and the rear legs 29. The back 27 is integrally molded with and joined with the seat 25 and the rear legs 29. The front legs 28 are integrally molded with and joined with the seat 25, the arms 26 and the rockers 10. The rear legs 29 are integrally molded with and joined with the seat 25, the arms 26, the back 27, a rear strut 30 and the rockers 10. In this example, the arms 26 are spaced from the back 27.

The rockers 10 have a downwardly curved overall configuration from front to rear such that when viewed from directly above each rocker 10 is straight or non-bowed outwardly or inwardly from front to rear. However rockers 10 may also be bowed outwardly or inwardly when viewed from above in addition to being bowed downwardly.

Although rocker 10 has been characterized as being downwardly bowed, it may have an increased radius, or even a local flat, on its bottom surface at or near the rocker's rear termination point to stop or slow the rocking motion that will discourage tipping the occupied rocking chair over backwards while rocking.

Figure 2:
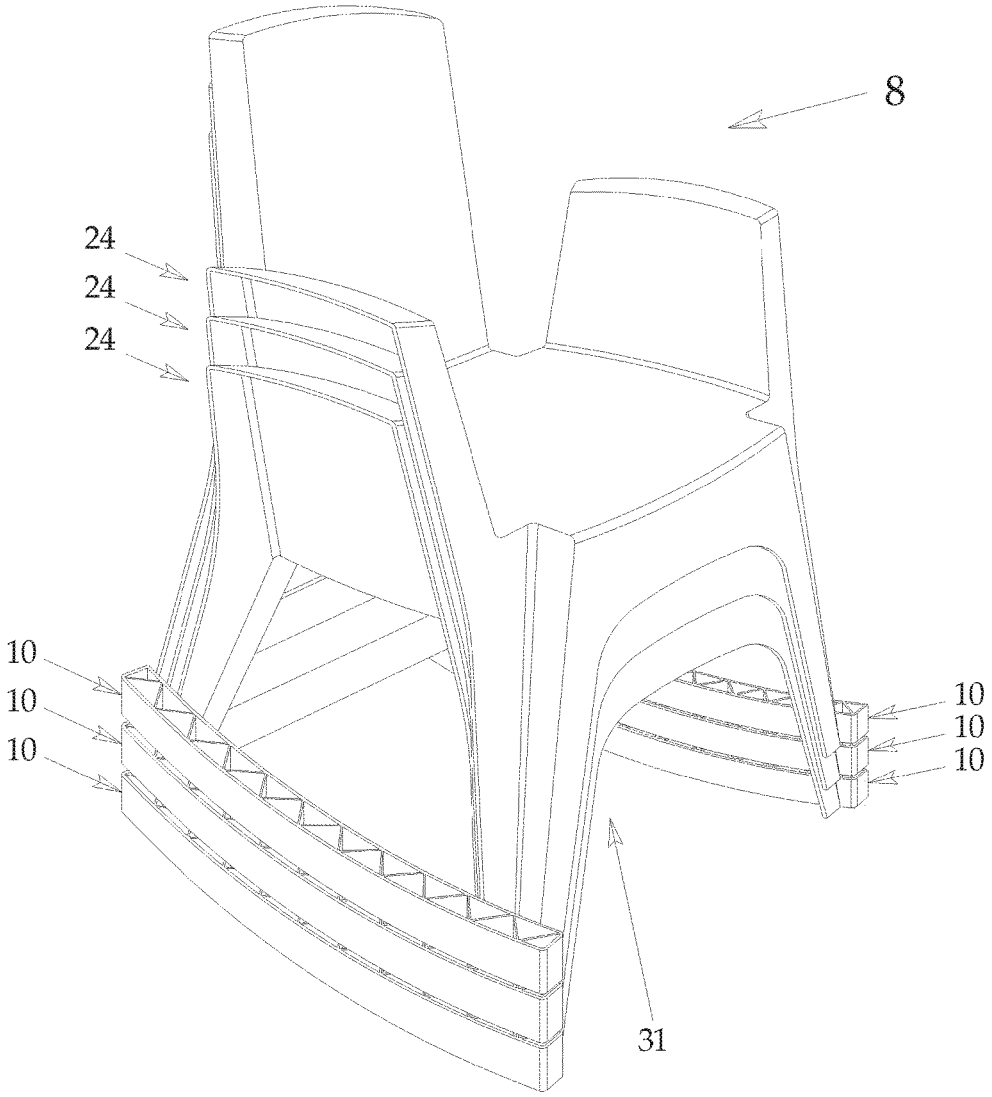
FIG. 2 is a perspective view of the rocking chair of FIG. 2 stacked with two other substantially identical rocking chairs.

Referring to FIG. 2, three rocking chairs 8 of FIG. 1 of the present disclosure are shown in a stacked condition. The rocking chair bodies 24 have a downwardly and outwardly splaying cavity 31 below the seat to allow substantially identical rocking chair bodies 24 to nest or stack largely within adjacent cavities 31, as illustrated. The vertical height of the rockers 10, from the ground up to the rockers' top surface, will limit how tightly the rocking chair bodies 24 can stack or nest because the rockers 10 are substantially vertical or perpendicular to the ground upon which the rocking chair sits and therefore the rockers 10 will stack substantially directly on top of one another as shown in FIG. 2.

The general principles of construction of the above described stackable rocking chair body are set forth in the Woodring utility patents noted above. Those patents illustrate various examples of rocking chair bodies that will stack. The rocking chair body 24 of the present disclosure is yet another example. The rocking chair body of the present disclosure is very similar in overall appearance to the rocking chair body disclosed in the Woodring U.S. Design Pat. No. D703,961 issued on May 6, 2014.

With respect to the following examples, only a portion of the rocker 10 is shown and described. Clearly, the rocker 10 extends to its full length as shown in FIG. 1.

Figure 3:
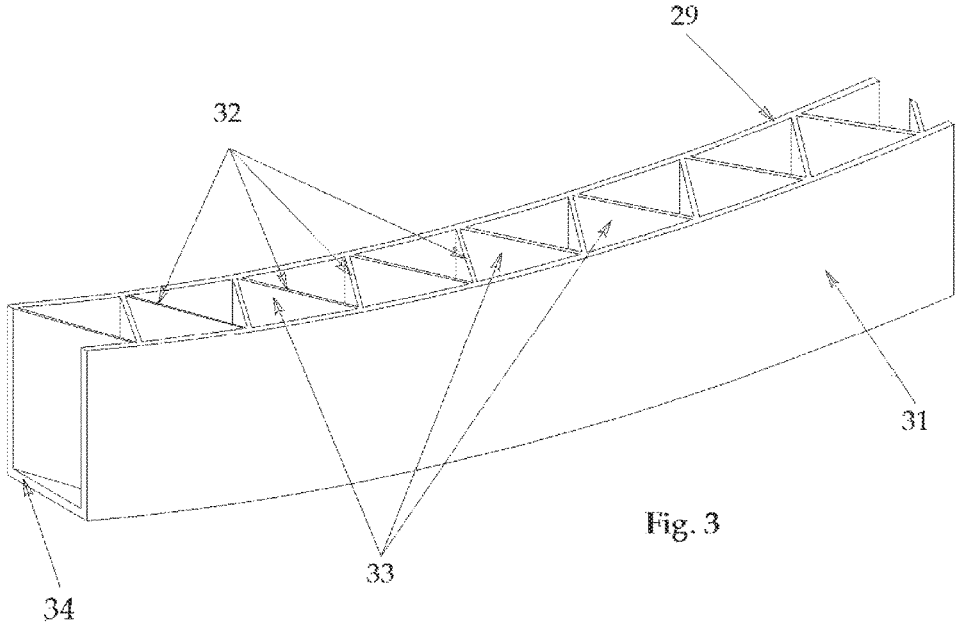
FIG. 3 is a trimetric view of a portion of a rocker of the present disclosure showing one example of a configuration of the internal thin-wall ribs that form the individual cells.
Figure 4:
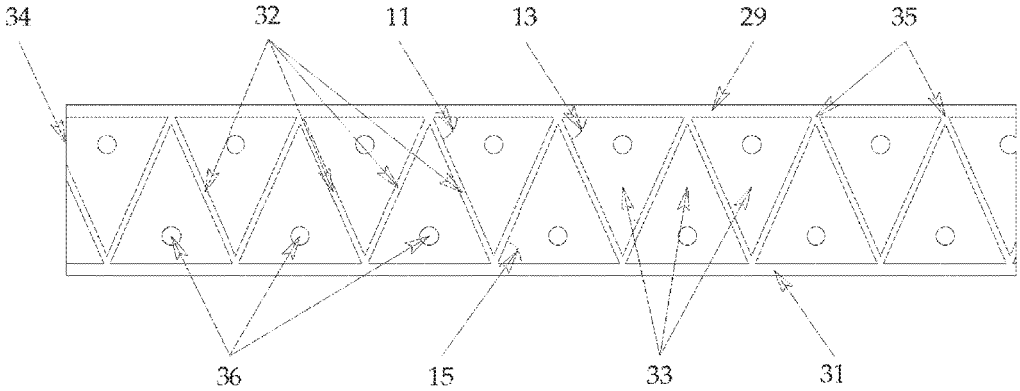
FIG. 4 is a top plan view of a portion of the rocker of FIG. 3.

FIGS. 3 and 4 show one example of a rocker 10 according to the present disclosure taken roughly between lines 3-3 of FIG. 1. Rocker 10 includes an inner sidewall 29 and an outer sidewall 31, each being substantially vertical. I prefer that rocker 10 has a closed bottom wall 34. Bottom wall 34 may include a plurality of drain holes 36. A plurality of thin-wall ribs 32 are arranged in a zigzag configuration between walls 29 and 31 to form closely-spaced polygonal cells 33. In this example, cells 33 are triangular. The zigzag triangular configuration of the thin-wall ribs 32 results in acute angles 11, 13 and 15 being formed between ribs 32 and inner and outer sidewalls 29 and 31. Angles 11, 13 and 15 may be equal to one another, or unequal.

Figure 5:
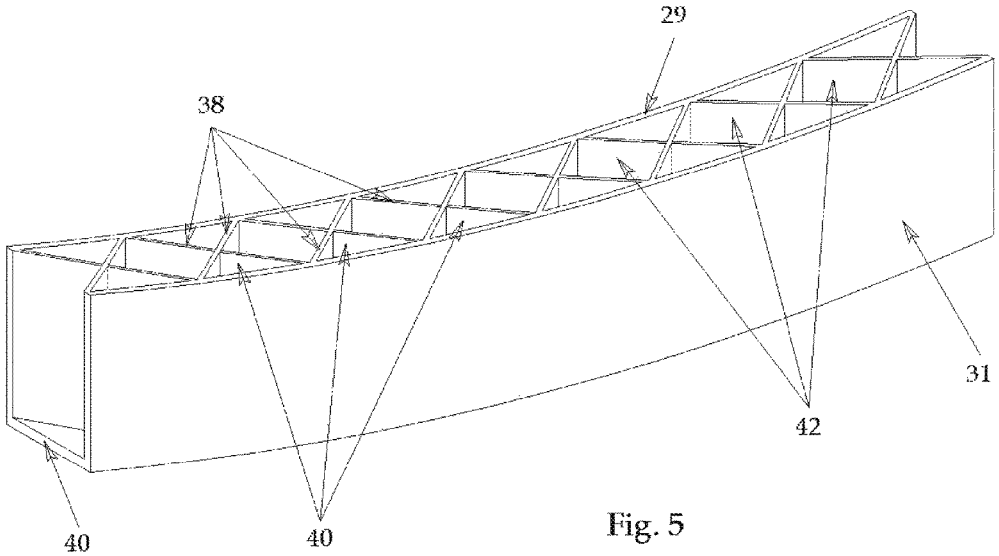
FIG. 5 is a trimetric view of a portion of a rocker of the present disclosure showing another example of the configuration of the internal thin-wall ribs that form the individual cells.
Figure 6:
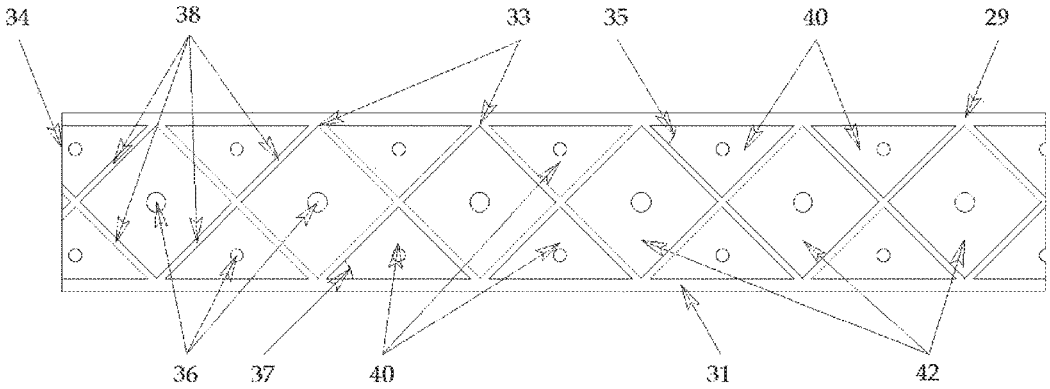
FIG. 6 is a op plan view of portion of the rocker of FIG. 5.

FIGS. 5 and 6 show another example of a configuration of thin-wall ribs 38 wherein the ribs 38 form a zigzag pattern extending from and joining the inner sidewall 29 to the outer sidewall 31. The thin-wall ribs 38 intersect with one another at approximately the rocker's longitudinal mid-point, creating polygonal parallelogram-shaped cells 42 set on the bias and triangular-shaped cells 40 adjacent the inner and outer sidewalls 29, 31. In other words, one leg (the base) of each triangular-shaped cell 40 comprises a portion of either the rocker's inner or outer sidewall 29, 31. The thin-wall ribs 38 form acute angles 35, 37 with the inner and outer sidewalls 29, 31.

The example of FIGS. 5 and 6 adds strength to the triangular-shaped cell configuration 40 by having the parallelogram-shaped cells 42 interspersed therebetween.

Thus, the rocker's interior thin-wall ribs may be characterized as being oriented in a zigzag manner and/or at an acute angle to the rocker's inner and outer sidewalls, thereby creating polygonal triangular-shaped and/or parallelogram-shaped cells within the rocker. Triangular-shaped cells—alone or in combination with parallelogram-shaped cells—have far greater rigidity and overall strength than a similar sized structure having interior thin-wall ribs oriented perpendicularly to the rockers' inner and outer sidewalls. This is because triangular-shaped structures have the ability to bear far greater loads without deformation. Triangles are considered the strongest shape because a triangular-shaped structure subjected to strong forces only collapses due to material fatigue, not from geometric distortion as can happen with box-like configurations. Thus, the triangular-shaped cells—alone or in combination with parallelogram-shaped cells—are believed to be of sufficient rigidity and strength to pass the necessary government and industry tests.

Figure 7:
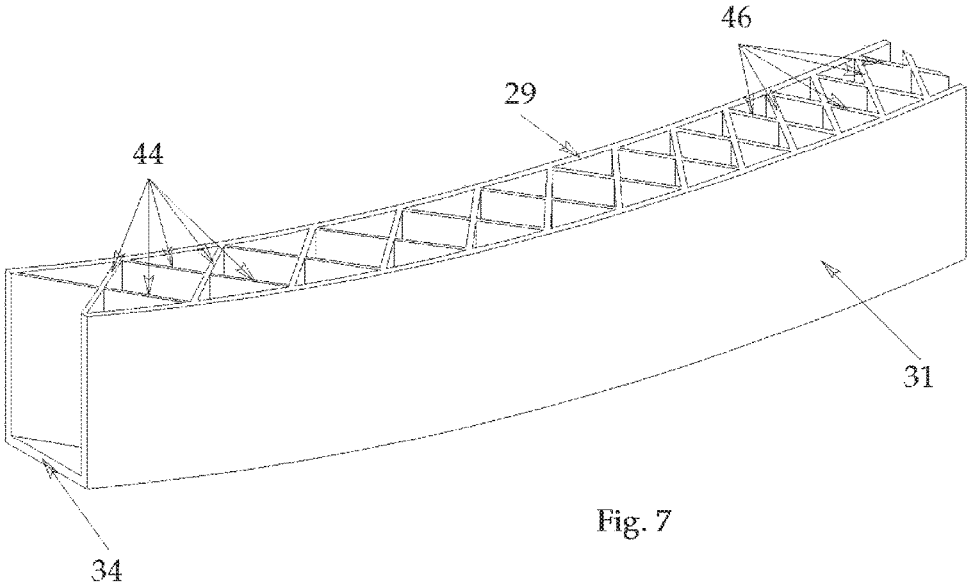
FIG. 7 is a trimetric view of a portion of a rocker of the present disclosure showing yet another example of the configuration of the internal thin-wall ribs that form the individual cells.
Figure 8:
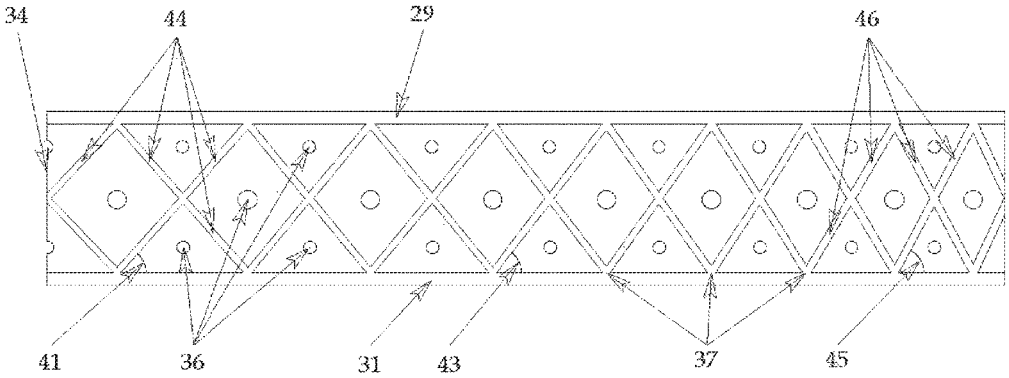
FIG. 8 is a top plan view of a portion of the rocker of FIG. 7.

FIGS. 7 and 8 show a thin-wall rib pattern similar to that shown in FIGS. 5 and 6, except in FIGS. 7 and 8 the pattern is gradated from wide thin-wall rib spacing 44 to narrow thin-wall rib spacing 46. In other words, in this example the thin-wall ribs vary in density along the rocker. More particularly, in this example the acute angles made by thin-wall ribs 44 with outer sidewall 31 increases from angle 41 to angle 43 to angle 45. A similar variable thin-wall rib spacing may be applicable to any of the other rib patterns of the present disclosure. The purpose of varying the spacing of the thin-wall ribs within the rocker is to allow tighter spacing of the thin-wall ribs where more strength and rigidity is needed and less tight spacing where less strength and rigidity is needed.

Figure 9:
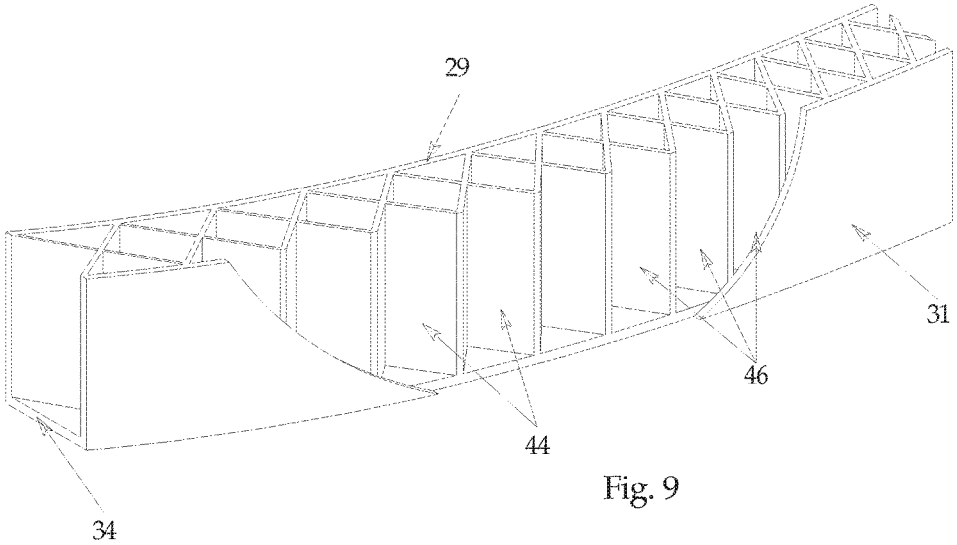
FIG. 9 is similar to FIG. 7 but showing a portion of a sidewall removed for clarity.

FIG. 9 shows the configuration of FIGS. 7 and 8 with a portion of the outer sidewall 31 broken away to see the internal structure more clearly. Wide thin-wall rib spacing 44 and narrow thin-wall rib spacing 46 are apparent.

Figure 10:
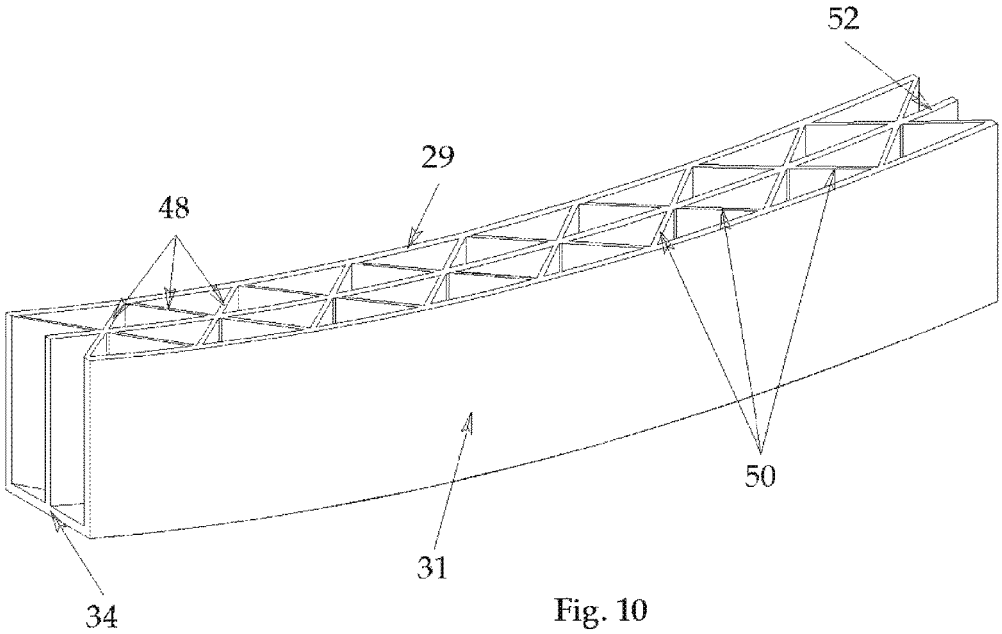
FIG. 10 is a trimetric view of a portion of a rocker of the present disclosure showing yet another example of the configuration of the internal thin-wall ribs that form the individual cells.
Figure 11:
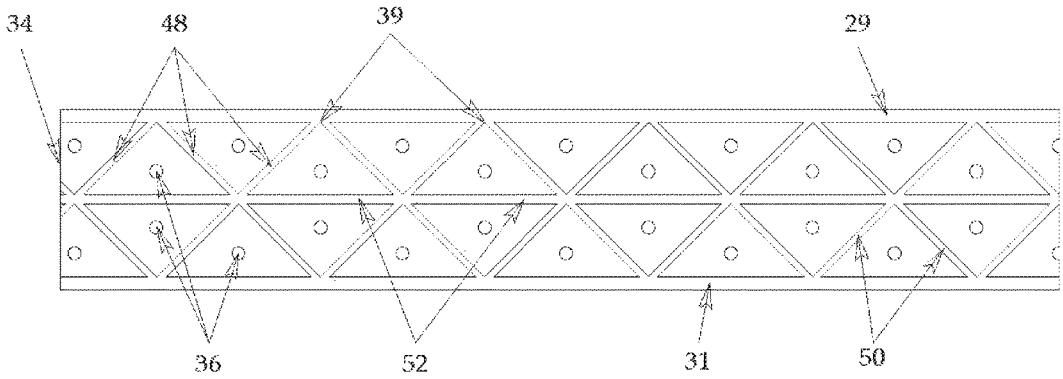
FIG. 11 is a top plan view of a portion of the rocker of FIG. 10.

FIGS. 10 and 11 show a portion of a rocker similar to that shown in FIGS. 5 and 6, except FIGS. 10 and 11 have an added longitudinal centrally located wall 52 bisecting the acute angled thin-wall ribs 48, 50, resulting in an all-triangular cell configuration. The central wall 52 may extend the full length of the rocker or may not extend the rocker's full length. It is possible, for example, that the central wall 52 may not extend the full length of the rocker, in which case both triangular-shaped cells and parallelogram-shaped cells can exist in the same rocker.

Full-scale, models were constructed for each of the rockers shown in FIGS. 3 through 11 so that each configuration could be evaluated for overall strength and rigidity compared to a rocker having thin-wall ribs oriented perpendicular, or at 90°, to the inner and outer sidewalls of the rocker. The rockers shown in FIGS. 3 through 11 all have their thin-wall ribs oriented at an acute angle to the inner and outer sidewalls of the rocker. Another way to say this is that the thin-wall ribs extend in a zigzag configuration with respect to the inner and outer sidewalls of the rocker.

Based on experimenting with and evaluating the full-scale models of rockers having various thin-wall rib configurations, the thin-wall ribs shown in FIGS. 3 through 11 all appear to provide the rigidity, structural integrity and strength required such that rockers 10 can pass, and even exceed, the required government strength test (currently known as ASTM F 1561-03) and other similar industry strength tests.

In FIG. 6 each thin-wall rib joins the inner and outer sidewalls 29, 31 adjacent to one another, so that the thin-wall ribs intersection with the sidewalls is actually two thin-wall ribs wide, as indicated by reference numeral 33. In FIG. 4 the thin-wall ribs are overlapping one another where they join the sidewalls such that the intersection with the sidewalls is only one thin-wall rib wide, as indicated by reference numeral 35. This same variation is applicable to any of the thin-wall rib patterns shown in FIGS. 3 through 11. Another example of this difference can be seen in FIG. 8 and FIG. 11. In FIG. 8 the thin-wall ribs join the sidewalls in a one thin-wall rib wide configuration 37, whereas in FIG. 11 the thin-wall ribs join the sidewalls in a two thin-wall rib wide configuration 39. The one-rib wide configuration as shown in FIGS. 4 and 8 will cause less of a sink-mark on the exterior facing surface of the inner and outer sidewalls at the point where the thin-wall ribs join the interior of the sidewall.

The drain holes 36 are shown in various sizes and locations in the examples of FIGS. 4, 6, 8, and 11, and they may be shapes other than the circular shapes shown. It should be understood that increasing the drain opening's numbers and/or sizes would slightly reduce the rocker's footprint, or ground contact surface area while increasing the ability to drain liquids out of the rockers' cells.

In order to better understand the present disclosure, and by way of a non-limiting example, if a rocking chair weighs 10 pounds and an occupant weighs 350 pounds, the total weight of chair and occupant is 360 pounds. Since a rocking chair has two such rockers, there will be 180 pounds of pressure on each rocker (360 pounds÷2 rockers=180 pounds per rocker). That weight is spread over the area of contact with the ground, which is the width of each rocker multiplied by some length of each rocker, depending on the downward curvature of the rocker. For example, if the curvature of the rocker's bottom surfaces has a radius of 32 inches, then the rocker's length of contact with the ground surface will be approximately 1.25 inches, based on experimenting with pressing a 32 inch radius rocker onto a hard and flat inked surface and measuring the area of transfer of the ink onto the rocker's curved bottom surface. If, for example the width of the rocker is 1.75 inches, then the total contact area of each rocker will be 2.1875 square inches (1.25" length×1.75" width=2.1875" total area). Dividing the above example's weight of 180 pounds per rocker by each rocker's surface contact area of 2.1875 square inches, yields less than 83 pounds per square inch of pressure on the surface upon which the rocking chair sits (180 pounds÷2.1875 square inches=82.3 pounds per square inch); a pressure low enough to prevent damage to a hard wood floor, as an example.

The larger the rocker-to-ground surface area, the less chance there is of marring the surface upon which the rocking chair sits. The pressure on each rocker can be reduced by increasing the width of the rocker or by increasing the radius of the curvature of the lower surface of the rocker 10 which will lengthen the contact area of the rocker.

The examples shown in FIGS. 3 through 11 are not intended to be limiting, as other angles, numbers, spacing and configurations of thin-wall ribs may be used.

The bottom surface of the closed bottom U-shaped rocker, i.e., its ground contacting portion, may be thicker than the thin-wall ribs or thicker than even the sidewalls of the U-shaped rocker, which themselves may be thicker than the thin-wall ribs. This is because the bottom surface is most subject to abrasion from, for example, dragging the rocking chair around on a rough concrete floor. Another reason for thickening the bottom surface is because typically horizontally oriented components are substantially more subject to deforming under load than are vertically oriented components such as the rocker's sidewalls and/or thin-wall ribs. It is this load-bearing characteristic that allows the vertical load-bearing components to be thinner than the horizontal load-bearing components, while still providing the necessary strength and rigidity.

Preferably, there may be several different thicknesses to the rocker's component parts, with, for example, the horizontal ground contacting bottom portion being the thickest, the rocker's vertical thin-wall ribs being the thinnest and the rocker's inner sidewall, outer sidewall and central sidewall being between the thicknesses of the bottom portion and the thin-wall ribs.

The rocker's horizontal ground contacting bottom portion may vary in thickness from thinnest at or near its ends to thickest around its midsection because most wear from abrasion is likely to occur around the rocker's center one-third of its overall length.

The rocker's thickest part should preferably not be more than about ⅛" or 0.125" in thickness in order to keep mold cycle time to a minimum. The rocker's thinnest part should not be less than about 1/32" or 0.03125" as it becomes increasingly difficult to get molten resin to flow into a thinner void, particularly when the void is a considerable distance from the resin's closest injection point, since the resin cools and becomes less viscous as it travels further from its point of injection into the mold.

Figure 12:
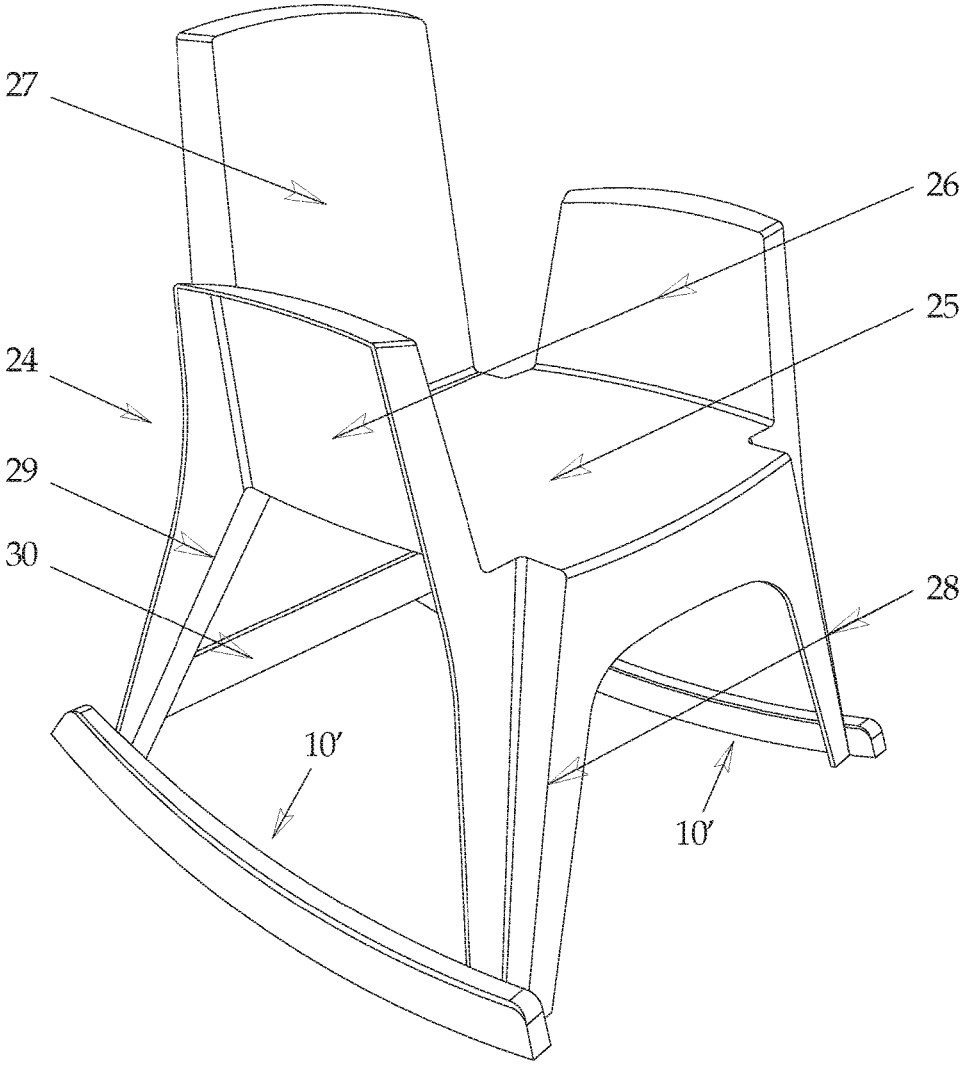
FIG. 12 is a perspective view of another example of a rocking chair of the present disclosure.
Figure 13:
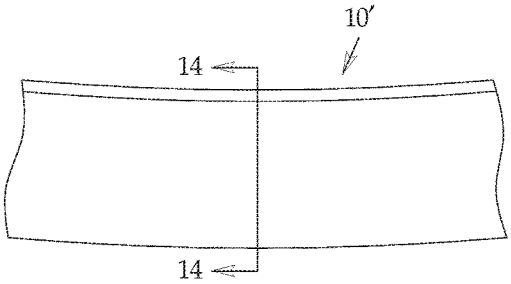
FIG. 13 is a side view of a portion of the rocker of the chair of FIG. 12.
Figure 14:
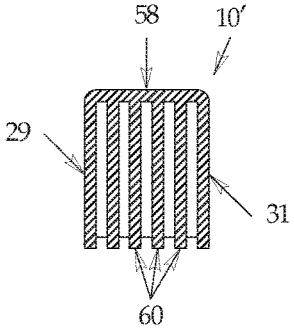
FIG. 14 is a cross-sectional view taken along line 14-14 of FIG. 13.
Figure 15:
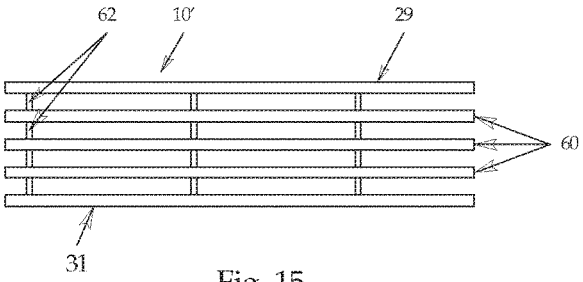
FIG. 15 is a bottom view of the rocker of FIGS. 13 and 14.
Figure 16:
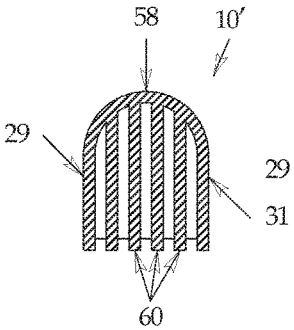
FIG. 16 is a cross-sectional view of another example of a rocker.
Figure 17:
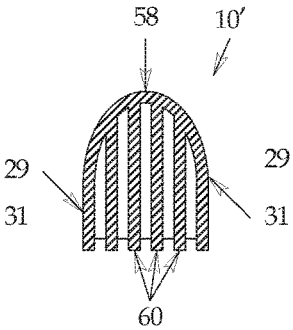
FIG. 17 is a cross-sectional view of another example of a rocker.
Figure 18:
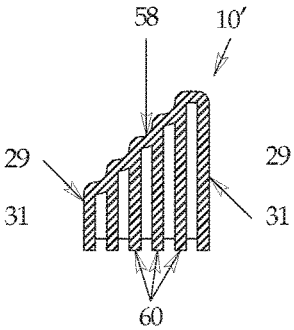
FIG. 18 is a cross-sectional view of another example of a rocker.
Figure 19:
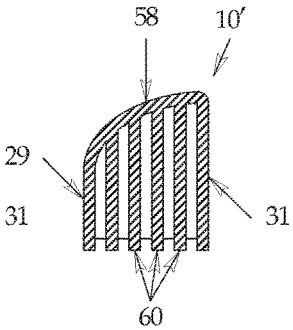
FIG. 19 is a cross-sectional view of another example of a rocker.

FIG. 12 is another example of a rocking chair that differs from FIG. 1 in that the rockers 10' are closed at the top, and open at the bottom. Such a configuration may be preferable in the event that the open top rocker of FIG. 1 proves undesirable from an aesthetics standpoint, i.e., the thin-wall ribs are visible to the consumer in the open-top rocker configuration of FIG. 1. An example of a closed-top, open-bottom rocker configuration is shown in FIGS. 13, 14 and 15, wherein rocker 10' has a closed upper wall 58, an open bottom, and a plurality of thin-wall ribs 60 that extend substantially parallel to the rockers' inner and outer sidewalls. As seen in FIG. 15, ribs 60 may be further supported by transverse struts 62 extending therebetween.

FIGS. 16, 17, 18 and 19 show other examples of closed-top, open bottom rockers with different thin-wall rib configurations.

Figure 20:
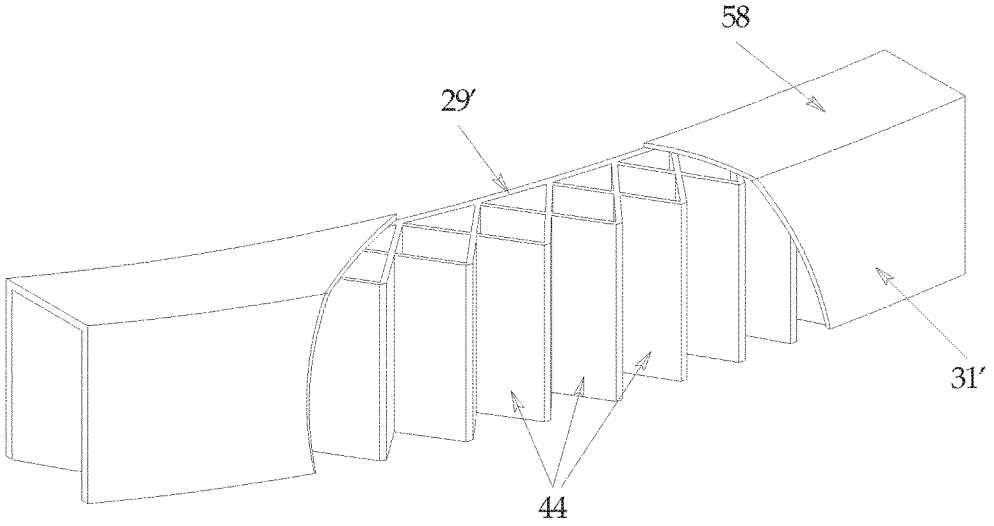
FIG. 20 is similar to FIG. 9 but illustrates a closed top, open bottom rocker configuration.

FIG. 20 is similar to FIG. 9 but shows a rocker with thin-wall ribs 44 in a triangular cell configuration extending between inner sidewall 29' and outer sidewall 31' in a closed top 58, open bottom rocker configuration. Parallelogram-shaped cells may also be included.

The rocking chair of the present disclosure is to be manufactured and sold as a one-piece rocking chair. If, however, one were to add a second part such as attaching a cup-holder to the one-piece rocking chair, that does not negate the fact that the rocking chair was molded in one-piece and could have been sold as a one-piece rocking chair. Adding an inconsequential second part to the one-piece rocking chair of the present disclosure does not escape the fact that the rocking chair was one-piece when it came out of the mold and it could have been sold as a one-piece rocking chair because without the added inconsequential cup-holder it passed the required government and industry strength tests.

I claim:

1. A stackable rocking chair comprising:

a seat, a back, a pair of front legs, and a pair of rear legs, said front and rear legs splayed downwardly and outwardly from said seat so as to form a downwardly and outwardly diverging cavity below said seat that permits a second substantially similar rocking chair to be nested largely within said cavity;

a pair of rockers extending between said pair of front and rear legs, respectively, each of said rockers being downwardly curved and having an inner sidewall and an outer sidewall;

a curved bottom wall integral with and connecting said inner and outer sidewalls, a portion of said curved bottom wall touching the ground as the rocking chair rocks back and forth, said curved bottom wall including a plurality of drain holes;

said pair of rockers each having a plurality of substantially planar thin-wall ribs extending between said inner and outer sidewalls, said thin-wall ribs forming an acute angle with said inner and outer sidewalls, resulting in a plurality of polygonal cells;

said rockers having an open top between the inner and outer sidewalls such that said thin-wall ribs are substantially exposed at the top thereof;

wherein said seat, back, front legs, rear legs, rockers, inner and outer sidewalls, bottom wall, and thin-wall ribs are injection-molded in one piece; and wherein each of said thin-wall ribs are oriented at the same angle with respect to one another, and at a different angle with respect to said curved bottom wall, so as to permit a mold to be removed therefrom in an upward motion.

2. The rocking chair of claim 1, wherein said thin-wall ribs form a plurality of substantially triangular-shaped cells.

3. The rocking chair of claim 1, wherein said thin-wall ribs form a plurality of substantially parallelogram-shaped cells.

4. The rocking chair of claim 1, wherein said thin-wall ribs form a plurality of substantially triangular-shaped cells and a plurality of parallelogram-shaped cells.

5. The rocking chair of claim 1, wherein said thin-wall ribs form a plurality of substantially triangular-shaped and parallelogram-shaped cells that are unequally spaced along said rockers.

6. The rocking chair of claim 2, wherein said thin-wall ribs further includes a central wall formed substantially parallel to said inner and outer sidewalls.

7. The rocking chair of claim 6, wherein said central wall is positioned between opposing ones of said triangular-shaped cells.

8. The rocking chair of claim 1, wherein said thin-wall ribs are formed in a zigzag configuration.

9. The rocking chair of claim 8, wherein said zigzag configuration of said thin-wall ribs forms substantially triangular polygonal cells.

10. A stackable rocking chair, comprising:

a seat;

a downwardly and outwardly diverging cavity below said seat that permits a second substantially identical rocking chair to stack largely within said cavity;

a pair of rockers;

said rockers being downwardly curved;

said rockers having a substantially closed curved bottom wall, an inner sidewall, and an outer sidewall, said curved bottom wall including a plurality of drain holes;

said rockers having a plurality of thin-wall ribs positioned between and said bottom wall, said inner sidewall, and said outer sidewall;

said rockers having an open top between said inner and outer sidewalls such that said thin-wall ribs are substantially exposed at the top thereof;

said thin-wall ribs forming a plurality of substantially triangular-shaped cells;

wherein said seat, rockers, inner and outer sidewalls, bottom wall, and thin-wall ribs are injection-molded in one piece; and wherein each of said thin-wall ribs are oriented at the same angle with respect to one another, and at a different angle with respect to said curved bottom wall, so as to permit a mold to be removed therefrom in an upward motion.

11. The rocking chair of claim 10, wherein said thin-wall ribs form acute angles with said inner and outer sidewalls.

12. The rocking chair of claim 10, wherein said thin-wall ribs further comprise a plurality of substantially parallelogram-shaped cells.

13. The rocking chair of claim 12, wherein said plurality of substantially triangular-shaped and parallelogram-shaped cells are unequally spaced along said rockers.

14. The rocking chair of claim 11, wherein said thin-wall ribs further includes a central wall formed substantially parallel to said inner and outer sidewalls.

15. A stackable rocking chair, comprising:

a seat, a back, a pair of front legs, and a pair of rear legs, said front and rear legs splayed downwardly and outwardly from said seat so as to form a downwardly and outwardly diverging cavity below said seat that permits a second substantially similar rocking chair to be nested largely within said cavity;

a pair of rockers extending between said pair of front and rear legs, respectively, each of said rockers being downwardly curved and having an inner sidewall, an outer sidewall, and a curved bottom wall connecting said inner sidewall and said outer sidewall, a portion of said curved bottom wall touching the ground as the rocking chair rocks back and forth, said curved bottom wall including a plurality of drain holes;

said pair of rockers each having a plurality of thin-wall ribs extending in a zigzag configuration between said inner and outer sidewalls, which results in a plurality of cells;

said rockers having an open top between the inner and outer sidewalls such that the top of said cells are substantially exposed;

wherein said seat, back, front legs, rear legs, rockers, inner and outer sidewalls, bottom wall, and thin-wall ribs are injection-molded in one piece; and wherein each of said thin-wall ribs are oriented at the same angle with respect to each other, and at a different angle with respect to said curved bottom wall.

16. The rocking chair of claim 15, wherein said cells are substantially triangularly-shaped.

17. The rocking chair of claim 15, wherein said cells are substantially parallelogram-shaped.

18. The rocking chair of claim 15, wherein said cells are substantially triangularly-shaped cells and parallelogram-shaped cells.

19. The rocking chair of claim 18, wherein said substantially triangularly-shaped and parallelogram-shaped cells are unequally spaced along said rockers.

20. The rocking chair of claim 15, wherein said thin-wall ribs further includes a central wall formed substantially parallel to said inner and outer sidewalls.

21. A one-piece, injection-molded, stackable rocking chair, comprising:

a seat;

a downwardly and outwardly diverging cavity below said seat that permits a second substantially identical rocking chair to stack largely within said cavity;

a pair of integrally injection-molded rockers;

said rockers being downwardly curved;

said rockers having a substantially closed curved bottom wall different portions of which touch the ground as said rocking chair rocks back and forth, an inner sidewall, and an outer sidewall, said bottom wall having a plurality of drain holes;

said rockers having a plurality of thin-wall ribs positioned between said bottom wall, said inner sidewall, and said outer sidewall; and said thin-wall ribs forming a plurality of polygonal cells that are exposed at the top portion thereof.

22. A stackable rocking chair, comprising:

a seat;

a downwardly and outwardly diverging cavity below said seat that permits a second substantially identical rocking chair to stack largely within said cavity;

a pair of integrally injection-molded rockers;

said rockers being downwardly curved;

said rockers having a substantially closed curved bottom wall, an inner sidewall, and an outer sidewall, said bottom wall includes a plurality of drain holes;

said rockers having a plurality of thin-wall ribs positioned between and said bottom wall, said inner sidewall, and said outer sidewall;

said thin-wall ribs forming an acute angle with said inner and outer sidewalls, resulting in a plurality of polygonal cells, said cells being exposed at the top portion thereof;

wherein said seat, rockers, inner and outer sidewalls, bottom wall, and thin-wall ribs are injection-molded in one piece; and wherein each of said thin-wall ribs are oriented at the same angle with respect to one another, and at a different angle with respect to said curved bottom wall.

* * * * *